US006648313B2

(12) United States Patent
Navarro

(10) Patent No.: US 6,648,313 B2
(45) Date of Patent: Nov. 18, 2003

(54) CLAMPING ARTICLE AND METHOD

(76) Inventor: Ramon Navarro, 4800 Daleview Dr. Sp. #122, El Monte, CA (US) 91731

( * ) Notice: Subject to any disclaimer, the term of this patent is extended or adjusted under 35 U.S.C. 154(b) by 0 days.

(21) Appl. No.: 09/755,409

(22) Filed: Jan. 5, 2001

(65) Prior Publication Data

US 2001/0024007 A1 Sep. 27, 2001

Related U.S. Application Data

(63) Continuation-in-part of application No. 09/158,997, filed on Sep. 23, 1998, now abandoned.

(51) Int. Cl.[7] ..... B25B 1/00
(52) U.S. Cl. ..... 269/6; 181/131; 81/302
(58) Field of Search ..... 269/254 R, 6, 269/287; 24/587, 588, DIG. 17, DIG. 16, 131 R, 131 C, 129 B, 129 C, 115 A, 16 BB, 29, 28, 27, 270, 17 A, 17 B, 18, 23 EE

(56) References Cited

U.S. PATENT DOCUMENTS

| | | | | | |
|---|---|---|---|---|---|
| 111,618 | A | | 2/1871 | Devlin | |
| 1,376,395 | A | | 5/1921 | Boker | |
| 1,432,008 | A | | 10/1922 | Zanon | |
| 3,805,337 | A | * | 4/1974 | Branstetter | 24/27 |
| 3,909,889 | A | | 10/1975 | Emerson | |
| 4,247,090 | A | | 1/1981 | Hahn et al. | |
| 4,261,432 | A | * | 4/1981 | Gunterman | 181/131 |
| 4,505,010 | A | | 3/1985 | Arenhold | |
| 4,622,719 | A | * | 11/1986 | Rasmussen | 24/20 R |
| D292,554 | S | * | 11/1987 | Yagi | D8/396 |
| 4,907,477 | A | * | 3/1990 | Farber | 81/302 |
| 5,143,359 | A | | 9/1992 | Bush | |
| 5,228,174 | A | * | 7/1993 | Beasley | 24/28 |
| 5,460,461 | A | | 10/1995 | McGrath | |
| 5,474,268 | A | * | 12/1995 | Yu | 248/61 |
| 5,513,838 | A | | 5/1996 | Van Rossum | |
| 5,603,545 | A | * | 2/1997 | Benson | 294/150 |
| 5,765,820 | A | | 6/1998 | Marusiak | |
| 6,006,856 | A | * | 12/1999 | Skubal | 181/131 |
| 6,021,551 | A | * | 2/2000 | Detable et al. | 24/27 |
| 6,141,835 | A | * | 11/2000 | Wilson | 24/68 E |
| 6,308,381 | B1 | * | 10/2001 | Wilson | 24/68 E |
| 6,327,749 | B1 | * | 12/2001 | Antinone | 24/67 |

* cited by examiner

*Primary Examiner*—Joseph J. Hail, III
*Assistant Examiner*—Daniel Shanley
(74) *Attorney, Agent, or Firm*—Fulwider Patton Lee & Utecht, LLP

(57) ABSTRACT

In an article and method for clamping a plurality of objects together, the article includes a body portion, comprised of spring wire, formed in a generally C-shape. The body portion comprises a pair of side portions, an intermediate portion extending between and interconnecting the pair of side portions, and a pair of opposed free end portions extending from the pair of side portions and opposite the intermediate portion and forming a gap therebetween. The pair of opposed free end portions are resiliently biased toward a position proximate each other and spaced apart to the extent of the gap therebetween. They are adapted to be expanded away from each other upon the exertion of expansion pressure, to extend about the plurality of objects to be clamped therebetween, and to return to the resiliently biased position to exert pressure on the plurality of objects therebetween upon the release of the expansion pressure.

15 Claims, 3 Drawing Sheets

CLAMPING ARTICLE AND METHOD

RELATED APPLICATIONS

This application is a continuation-in-part of application Ser. No. 09/158,997 filed Sep. 23, 1998.

BACKGROUND OF THE INVENTION

1. Field of the Invention

This invention relates generally to improvements in clamping articles and, more particularly, to a new and improved article and method for clamping a plurality of objects together to form a bonded unit in a secure and effective manner.

2. Description of the Related Art

It has been known to provide an article for clamping objects such as sheets of material together to form a bonded unit, wherein the objects to be bonded together may include a layer therebetween of a material for enabling the objects to be secured together. The clamping article is adapted to exert pressure on the objects at points along the surfaces thereof and/or at junctions of the objects such as corners thereof which may be angular, curved, or squared, to enable bonding of the objects together.

However, such clamping articles have been inefficient and limited in use, in that they have been bulky and adapted to clamp only a limited ranges of sizes of objects together, and they have also been expensive and inconvenient to utilize. Further, such clamping articles have not been designed for use in a wide range of clamping projects, and have not been practical for clamping objects at multiple locations together.

Therefore, those concerned with the development and use of improved clamping articles and methods and the like have recognized the need for improved articles and methods for clamping a plurality of objects together to form a securely bonded unit.

Accordingly, the present invention fulfills these needs by providing efficient and effective articles and methods for clamping a plurality of objects together in a secure, effective, convenient, and efficient manner.

SUMMARY OF THE INVENTION

Briefly, and in general terms, the present invention provides a new and improved system and method for clamping a plurality of objects together, in a secure, efficient and effective manner, while enabling convenient and efficient positioning, engagement, release, and disengagement thereof in the method of securing the objects together.

By way of example, and not by way of limitation, the present invention provides a new and improved system for clamping a plurality of objects together in a secure manner, that is convenient to utilize, adaptable to a range of clamping projects, and efficient and effective for clamping a multitude of areas on the object together. It may be effectively utilized, for example, for securely holding objects such as sheets of material and/or angled corners together for gluing or nailing thereof, for securely holding moldings or forms for leveling together, for laminating, and/or for repairing furniture.

More particularly, the present invention may comprise an article for clamping a plurality of objects together, which includes a body portion, comprised of spring wire, formed in a generally C-shape. The body portion includes a pair of side portions, an intermediate portion extending between and interconnecting the pair of side portions, and a pair of opposed free end portions extending from the pair of side portions and opposite the intermediate portion and forming a gap therebetween. The pair of opposed free end portions are resiliently biased toward a position proximate each other, and spaced apart to the extent of the gap therebetween for enabling the secure clamping of the objects therebetween. They are adapted to be expanded away from each other upon the exertion of expansion pressure, to extend about the plurality of objects to be clamped therebetween, and to return to the resiliently biased position to exert pressure on the plurality of objects therebetween upon the release of the expansion pressure. Each of the pair of side portions includes a portion adapted to enable engagement thereof and pressure to be exerted thereon for expansion of the clamping article. The pressure exertion enabling portion of each of the pair of side portions is generally curved outwardly away from the opposite side portion. The generally outwardly curved pressure exertion enabling portions of the pair of side portions are adapted to provide leverage for enabling the exertion of expansion pressure thereon, and to hold the opposed free end portions in alignment to prevent twisting or movement thereof out of position. The intermediate portion of the clamping article includes a medial portion generally curved inwardly towards the pair of opposed free end portions. The generally inwardly curved medial portion of the intermediate portion is adapted to insure the return of the article to the resiliently biased unexpanded position upon the release of expansion pressure.

An element in the present invention for covering a pointed tip of the clamping article is adapted to be positioned on one of the pair of opposed free end portions of the clamping article. It includes a surface adapted to face and be positioned opposite the other of the pair of opposed free end portions. The covering element includes an element for enabling movement thereof relative to the pointed tip, such that the covering element is adapted to face and bear against one of the plurality of objects to be clamped by the article. The movement enabling element is adapted to enable rotatable movement of the covering element.

The present invention may also comprise an element for enabling the application of pressure to and expansion of the clamping article, and to provide leverage for enabling the exertion of pressure thereon. The expansion enabling element may include a pair of arms, pivotally connected together by a pivot. Each arm may include a handle portion, and a generally outwardly extending portion. A biasing spring interconnects the pair of handle portions, and biases the pair of outwardly extending portions in the unexpanded position thereof. Each of the pair of generally outwardly extending portions includes a stepped and indented surface, with corresponding pairs of such surfaces adapted to safely and positively engage and enable expansion of the outwardly extending portions of the expansion enabling element, at different locations thereof, while preventing slipping thereof, upon engaging the generally outwardly curved portion of each of the pair of side portions of the clamping article, for opening and expanding thereof.

In another embodiment of the clamping article of the present invention, the body portion is formed in a generally block-C-shape. The pair of opposed free end portions are adapted to be aligned, and the generally block-C-shape of the article is adapted to maintain the alignment of the pair of opposed free end portions. The pair of opposed free end portions includes a tip portion bent so as to extend generally inwardly towards the intermediate portion. The body portion is generally round in cross-section, each of the bent tip portions includes a portion adapted to face and be positioned opposite the other bent tip portion and one of the plurality of objects, and the facing portion includes a surface adapted to contact the one of the plurality of objects which it is adapted to face. The contacting surface comprises a generally thin edge of the bent tip portion.

These and other objects and advantages of the invention will become apparent from the following more detailed description, when taken in conjunction with the accompanying drawings of illustrative embodiments.

DETAILED DESCRIPTION OF THE PREFERRED EMBODIMENTS

The present invention is directed to an improved system and method for clamping a plurality of objects together, in a convenient, and efficient manner. The improved system and method provides effective clamping of the objects together to form a securely bonded unit. The preferred embodiments of the improved system and method are illustrated and described herein by way of example only and not by way of limitation.

Figure 1:
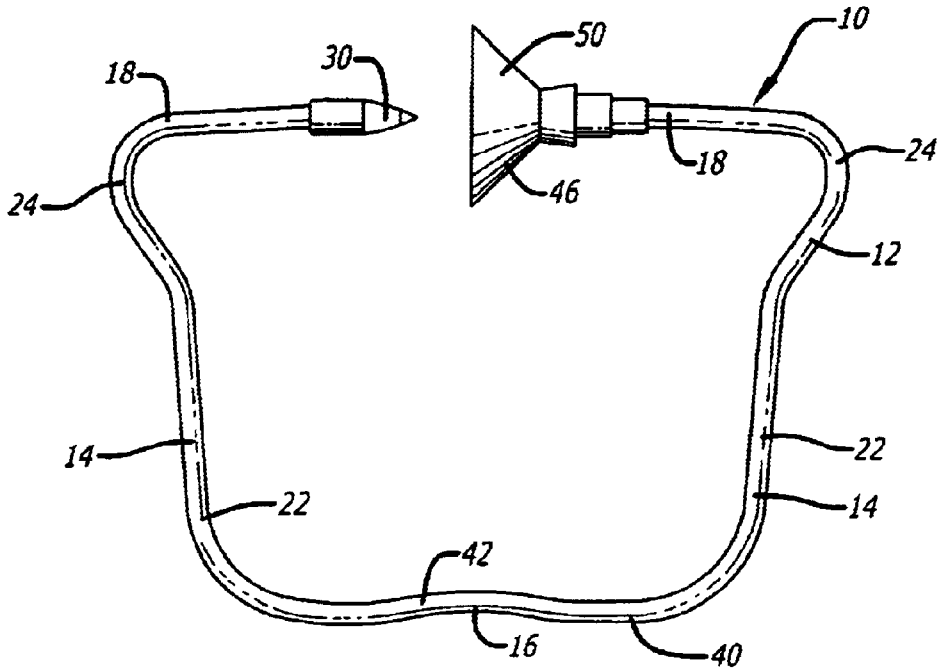
FIG. 1 is an elevational view of an embodiment of a clamping article in accordance with the present invention.
Figure 2:
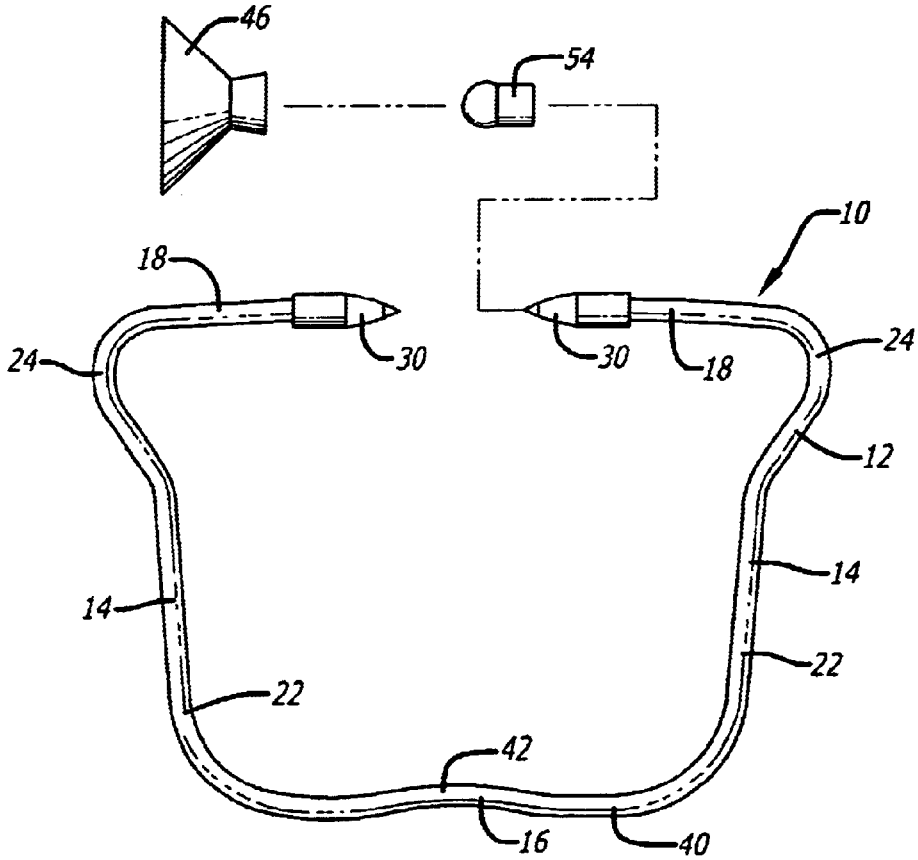
FIG. 2 is a similar view with a pointed tip covering element of the clamping article shown in exploded view, pursuant to the invention.
Figure 3:
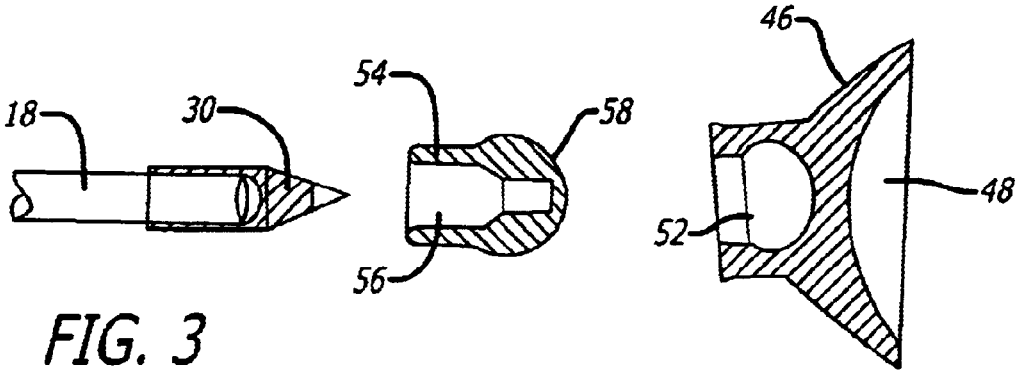
FIG. 3 is a fragmentary view of a pointed tip and an exploded view of the pointed tip covering element of the clamping article, in the practice of the invention.

Referring now to the drawings, wherein like reference numerals denote like or corresponding parts throughout the drawings in FIGS. 1–5, and particularly to FIGS. 1–3, an article 10 is adapted to be utilized for clamping a plurality of objects such as a plurality of sheets together. The plurality of sheets may be comprised of a material such as wood or marble, to be laminated together upon bonding thereof. There may be a layer of a material such as glue between the plurality of sheets, for enabling the plurality of sheets to be secured together responsive to the application of pressure thereto by the clamping article 10.

The clamping article 10 includes a body portion 12, for example comprised of spring wire and formed in a generally C-shape. The body portion 12 is preferably round in cross-section. In a preferred embodiment, the body portion 12 is formed in a generally block-C-shape. The body portion 12 is comprised of a pair of side portions 14, an intermediate portion 16 extending between and interconnecting the pair of side portions 14, and a pair of opposed free end portions 18 extending from the pair of side portions 14 and opposite the intermediate portion 16, and forming a gap 20 therebetween. The pair of opposed free end portions 18 are adapted to be aligned, and in the generally block-C-shape embodiment of the covering article 10, such block-C-shape is adapted to maintain the alignment thereof. The pair of opposed free end portions 18 are resiliently biased toward a position proximate each other and spaced apart to the extent of the gap 20 therebetween. They are adapted to be expanded away from each other upon the exertion of expansion pressure, to extend about the plurality of objects to be clamped therebetween, and to return to the resiliently biased position to exert pressure on the plurality of objects upon the release of the expansion pressure.

Figure 4:
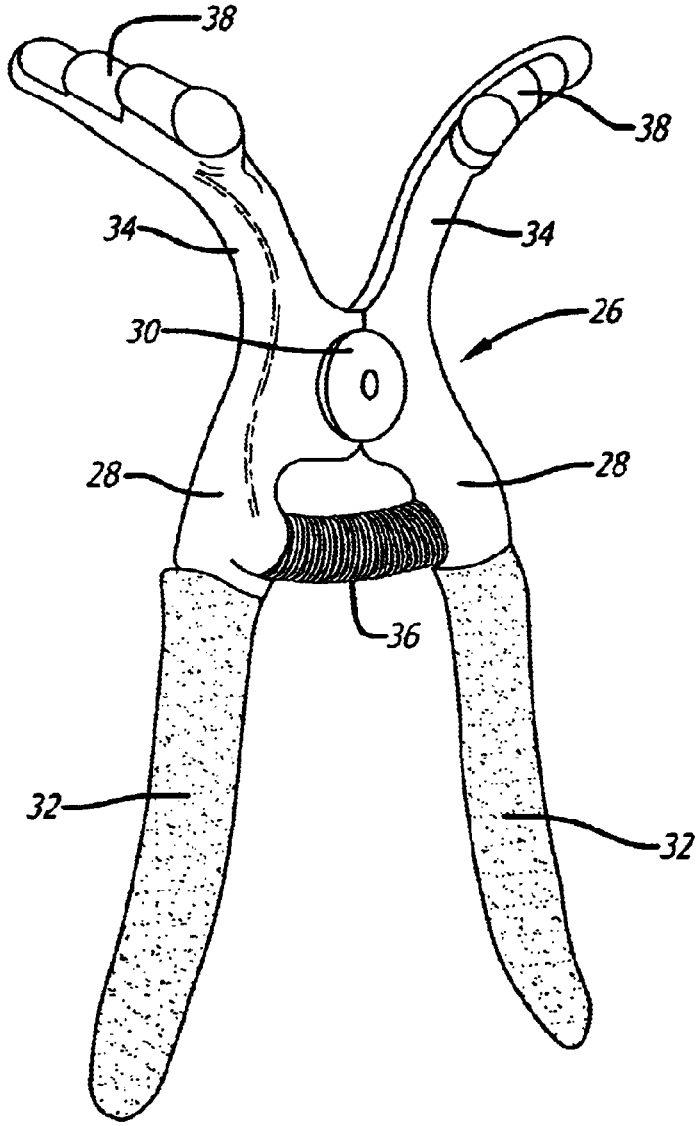
FIG. 4 is an elevational view of an embodiment of an article for engaging and expanding the clamping article, in accordance with the invention.

Each of the pair of side portions 14 preferably includes a generally straight portion 22, and a portion 24 adapted to enable pressure to be exerted thereon for expansion of the article 10, which is generally curved outwardly away from the opposite side portion 14. The generally outwardly curved portion 24 of each of the pair of side portions 14 is located proximate the opposed free end portion 18 extending therefrom. The generally outwardly curved portion 24 of each of the pair of side portions 14 is adapted to be engaged by an element 26 for enabling the application of pressure thereto and expansion thereof, and to provide leverage for enabling the exertion of pressure thereon. The expansion enabling element 26, for example, as shown in FIG. 4, may include a pair of arms 28, pivotally connected together by a pivot 30. Each arm 28 includes a handle portion 32, and a generally outwardly extending portion 34. A biasing spring 36 interconnects the pair of handle portions 32, and biases the pair of outwardly extending portions 34 in the unexpanded position thereof. Each of the pair of generally outwardly extending portions 34 includes a stepped and indented surface 38, with corresponding pairs of the stepped surfaces 38 adapted to engage and enable expansion of the outwardly extending portions 34 of the expansion enabling element 26, at different locations thereof, upon engaging the generally outwardly curved portion 24 of each of the pair of side portions 14 of the clamping article 10, for opening and expanding thereof.

The intermediate portion 16 of the clamping article 10 preferably includes a generally straight portion 40, and a medial portion 42 curved inwardly towards the pair of opposed free end portions 18. Each of the pair of opposed free end portions 18 preferably includes a pointed tip 44. The medial generally inwardly curved portion 42 of the intermediate portion 16 is adapted to enable the return of the clamping article 10 to the resiliently biased position thereof upon the release of expansion pressure applied to the clamping article 10.

In an embodiment as seen in FIGS. 1-3, the clamping article 10 further includes an element 46 for covering a pointed tip 44, adapted to be positioned on one of the pair of opposed free end portions 18, including a surface 48 adapted to face and be positioned opposite the other of the pair of opposed free end portions 18. The facing surface 48 is preferably generally suction-cup shaped. The covering element 46 preferably includes an element 50 for enabling movement thereof relative to the pointed tip 44, such that the covering element 46 is adapted to face and bear against one of the plurality of objects to be clamped by the clamping article 10. The movement enabling element 50 is preferably adapted to enable rotatable movement of the covering element 46. As seen in FIG. 3, the covering element 46 includes for example a cavity 52 in the end thereof opposite the facing surface 48. The clamping article 10 may further include an element 54 adapted to be positioned intermediate the pointed tip 44 and the covering element 46. The intermediately positionable element 54 includes a cavity 56 at one end thereof, generally complementary to the shape of the pointed tip 44, and a shaped opposite end 58 thereof generally complementary in shape to the shape of the cavity 52 in the covering element 46. The cavity 52 in the covering element 46 is preferably round, and the shaped opposite end 58 of the intermediately positionable element 54 is also preferably round.

Figure 5:
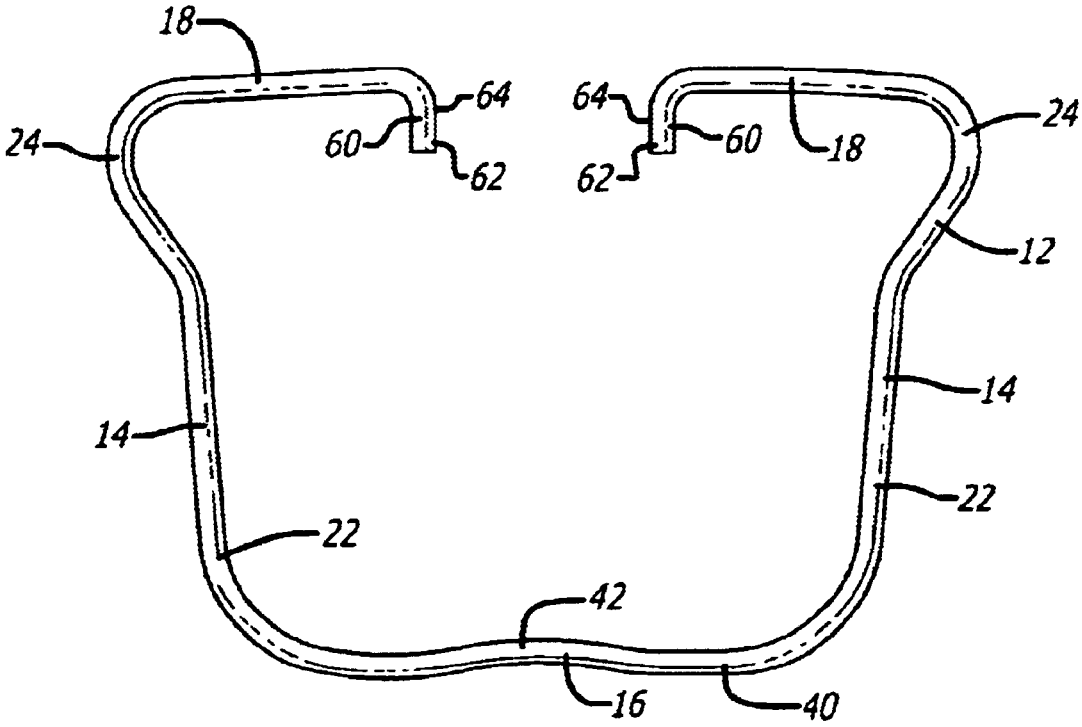
FIG. 5 is an elevational view of another embodiment of a clamping article, pursuant to the present invention.

In another embodiment of the invention as illustrated in FIG. 5, each of the pair of opposed free end portions 18 includes a tip portion 60 bent so as to extend generally inwardly towards the intermediate portion 16. The body portion 12 of the clamping article 10 is generally round in cross-section, and each of the bent tip portions 60 includes a portion 62 adapted to face and be positioned opposite the other bent tip portion 60 and one of the plurality of objects. The facing portion 62 of each bent tip portion 60 includes a surface 64 adapted to contact one of the plurality of objects which it is adapted to face, and the contacting surface 64 preferably comprises a generally thin edge of the bent tip portion 60.

In the operation of the clamping article 10 of the invention, for example, a corresponding pair of the stepped surfaces 38 of the expansion enabling element 26 are adapted to engage the generally outwardly curved portion 24 of the each of the pair of side portions 14 of the clamping article 10. Pressure may then be exerted on the handle portions 32 of the expansion enabling element 26 to move the handle portions 32 towards each other against the biasing pressure of the biasing spring 36, such that the outwardly extending portions 34 of the expansion enabling element 26 move away from each other about the pivot 30, causing the generally outwardly curved portion 24 of each of the pair of side portions 14, with which the corresponding pair of the stepped surfaces 38 of the expansion enabling element 26 are engaged, to expand outwardly. The expanded pair of opposed free end portions 18 of the clamping article 10 may then be extended about the plurality of objects to be clamped therebetween.

The pressure exerted on the handle portions 32 of the expansion enabling element 26 may then be released, enabling the biasing spring 36 to bias and move the handle portions 32 away from each other, and the outwardly extending portions 34 thereof to move towards each other about the pivot 30, and enabling the return of the resiliently biased pressure of the clamping article 10, so as to exert pressure on the plurality of objects clamped between the opposed free end portions 18 of the clamping article 10. The movement enabling element 50 enables the movement thereof against the object to be clamped and relative to the pointed tip 44 of the clamping article 10, so as to directly face and contact the surface of one of the objects to be clamped by the clamping article 10. To release the clamping article 10 from exerting pressure on the plurality of objects clamped between the opposed free end portions 18 thereof, the above process of engagement and exertion of expansion pressure by the expansion enabling article 26 on the clamping article 10 may be repeated.

It will be apparent from the foregoing that, while particular forms of the invention have been illustrated and described, various modifications can be made without departing from the spirit and scope of the invention. Accordingly, it is not intended that the invention be limited, except as by the appended claims.

What is claimed is:

1. An article for clamping a plurality of objects together, including a body portion, comprised of spring wire, formed in a generally C-shape, comprising:

a pair of side portions;

an intermediate portion, extending between and interconnecting the pair of side portions; and a pair of opposed free end portions, extending from the pair of side portions and opposite the intermediate portion, and forming a gap therebetween;

wherein the pair of opposed free end portions are resiliently biased toward a position proximate each other and spaced apart to the extent of the gap therebetween, and are adapted to be expanded away from each other upon the exertion of expansion pressure on the pair of side portions, so as to extend about the plurality of objects to be clamped between the pair of opposed free end portions, and to resiliently compress towards each other and return to the resiliently biased position thereof to exert pressure on and clamp the plurality of objects between the pair of opposed free end portions upon the release of the expansion pressure and compression of the pair of side portions responsive thereto, wherein each of the pair of opposed free end portions includes a pointed tip.

2. The article of claim 1, wherein each of the pair of opposed free end portions includes a tip portion bent so as to extend generally inwardly towards the intermediate portion.

3. The article of claim 1, wherein the plurality of objects comprise a plurality of sheets of material, including a layer therebetween of material for enabling the plurality of sheets to be secured together responsive to the application of resiliently biased pressure by the clamping article.

4. The article of claim 1, further comprising an element for engaging and expanding the pressure exertion enabling portion of each of the pair of side portions.

5. The article of claim 1, further comprising an element for covering a pointed tip, adapted to be positioned on one of the pair of opposed free end portions, including a surface adapted to face and be positioned opposite the other of the pair of opposed free end portions.

6. The article of claim 2, wherein the body portion is generally round in cross-section, each of the bent tip portions includes a portion adapted to face and be positioned opposite the other bent tip portion and one of the plurality of objects, and the facing portion includes a surface adapted to contact the one of the plurality of objects which it is adapted to face.

7. The article of claim 5, wherein the covering element includes an element for enabling movement thereof relative to the pointed tip, such that the covering element is adapted to face and bear against one of the plurality of objects to be clamped by the article.

8. The article of claim 5, wherein the facing surface is generally suction-cup shaped.

9. The article of claim 5, wherein the covering element includes a cavity in the end thereof opposite the facing surface, and further comprising an element adapted to be positioned intermediate the pointed tip and the covering element, which intermediately positionable element includes a cavity at one end thereof generally complementary to the shape of the pointed tip, and a shaped opposite end thereof generally complementary in shape to the shape of the cavity in the covering element.

10. The article of claim 6, wherein the contacting surface comprises a generally thin edge of the bent tip portion.

11. The article of claim 7, wherein the movement enabling element is adapted to enable rotatable movement of the covering element.

12. The article of claim 9, wherein the cavity in the covering element is generally round in shape, and the shaped opposite end of the intermediately positionable element is generally round.

13. An article for enabling expansion of an article for clamping a plurality of objects together, wherein the clamping article includes a pair of opposed free end portions for clamping a plurality of objects therebetween, and a pair of side portions, each of which includes a portion adapted to enable engagement thereof and pressure to be exerted thereon for expansion of the clamping article, and wherein the expansion enabling article comprises:

an expansion-enabling element adapted to engage and exert pressure on the pressure exertion enabling portion of each of the pair of side portions of the clamping article for expansion of the clamping article, which includes a pair of handles, a pair of arms extending from the pair of handles, each including an end portion, a pivot interconnecting the pair of arms, and a spring interconnecting and biasing the pair of arms, such that the pair of arms expand upon pressing the pair of handles towards each other, wherein the end portions of the pair of arms are curved generally outwardly relative to each other, and each end portion includes a top stepped and indented surface.

14. A system for clamping a plurality of objects together, including:

an article for clamping a plurality of objects together, including a body portion, comprised of spring wire, formed in a generally C-shape, comprising a pair of side portions, an intermediate portion, extending between and interconnecting the pair of side portions, and a pair of opposed free end portions, extending from the pair of side portions and opposite the intermediate portion, and forming a gap therebetween, wherein the pair of opposed free end portions are resiliently biased toward a position proximate each other and spaced apart to the extent of the gap therebetween, and are adapted to be expanded away from each other upon the exertion of expansion pressure on the pair of side portions, so as to extend about the plurality of objects to be clamped between the pair of opposed free end portions, and to resiliently compress towards each other and return to the resiliently biased position thereof to exert pressure on and clamp the plurality of objects between the pair of opposed free end portions, upon the release of the expansion pressure and compression of the pair of side portions responsive thereof; and an expansion-enabling element adapted to engage and exert pressure on the pair of side portions of the clamping article for expansion of the clamping article, which includes a pair of handles, a pair of arms extending from the pair of handles, each including an end portion, a pivot interconnecting the pair of arms, and a spring interconnecting and biasing the pair of arms, such that the pair of arms expand upon pressing the pair of handles towards each other, wherein the end portions of the pair of arms are curved generally outwardly relative to each other, and each end portion includes a top stepped and indented surface.

15. A method of clamping a plurality of objects together, in an article which includes a body portion, comprised of spring wire, formed in a generally C-shape, and which comprises a pair of side portions, an intermediate portion, extending between and interconnecting the pair of side portions, and a pair of opposed free end portions, extending from the pair of side portions and opposite the intermediate portion, and forming a gap therebetween, wherein the pair of opposed free end portions are resiliently biased toward a position proximate each other and spaced apart to the extent of the gap therebetween, and are adapted to be expanded away from each other upon the exertion of expansion pressure on the pair of side portions, so as to extend about the plurality of objects to be clamped between the pair of opposed free end portions, and to resiliently compress towards each other and return to the resiliently biased position thereof to exert pressure on and clamp the plurality of objects between the pair of opposed free end portions, upon the release of the expansion pressure and compression of the pair of side portions responsive thereto, wherein the method comprises:

exerting pressure so as to engage and expand the pair of side portions, correspondingly expanding the pair of opposed free end portions;

extending the pair of opposed free end portions about the plurality of objects to be clamped therebetween; and releasing the expansion pressure on the pair of side portions such that the pair of opposed free ends resiliently compress towards each other and return to the resiliently biased position thereof to exert pressure on and clamp the plurality of objects between the pair of opposed free end portions.

* * * * *